United States Patent [19]

Eisenberg et al.

[11] 4,103,044

[45] Jul. 25, 1978

[54] METHOD FOR STORAGE OF RETRIEVABLE INFORMATION DISPERSION IMAGING MATERIAL AND METHOD

[75] Inventors: Adi Eisenberg, Montreal, Canada; Stanford R. Ovshinsky, Bloomfield Hills, Mich.

[73] Assignee: Energy Conversion Systems, Inc., Troy, Mich.

[21] Appl. No.: 745,455

[22] Filed: Nov. 26, 1976

Related U.S. Application Data

[62] Division of Ser. No. 227,962, Feb. 22, 1972, abandoned.

[51] Int. Cl. ..... G03g 13/00

[52] U.S. Cl. ..... 427/56; 427/180; 427/271; 427/282; 427/372 R; 96/67

[58] Field of Search ..... 264/126, 119, 230; 427/55, 56, 145, 180, 198, 271, 277, 282, 359, 372, 374

[56] References Cited

U.S. PATENT DOCUMENTS

| | | | |
|---|---|---|---|
| 2,234,994 | 3/1941 | Vernon et al. | 18/47.5 |
| 3,400,186 | 9/1968 | Wiley | 264/126 |
| 3,487,132 | 12/1969 | Thorne | 264/25 |
| 3,530,441 | 9/1970 | Ousihinsky | 340/173 |

*Primary Examiner*—Bernard D. Pianalto

*Attorney, Agent, or Firm*—Wallenstein, Spangenberg, Hattis & Strampel

[57] ABSTRACT

Imaging material comprising a layer which comprises deformed particulate organic polymeric material such as flattened spheres, which has a memory for its original particulate shape and which is capable of recovering its original particulate shape upon the application of energy above a certain threshold. Examples of suitable particulate material include polystyrene, as it is obtained by emulsion or perl-polymerization in the presence of crosslinking agents, or polyethylene in particulate form, which has been crosslinked by the application of high energy radiation.

4 Claims, 4 Drawing Figures

METHOD FOR STORAGE OF RETRIEVABLE INFORMATION DISPERSION IMAGING MATERIAL AND METHOD

This is a division, of application Ser. No. 227,962, filed Feb. 22, 1972 and now abandoned.

The present invention relates to new imaging materials and more specifically to imaging material in which an image is formed by the selective dispersion of a dispersion imaging material.

In the copending application Ser. No. 162,842 entitled METHOD FOR PRODUCING IMAGES filed on July 15, 1971 by R. W. Hallmann, S. R. Ovshinsky and J. P. deNeufville and now abandoned and assigned to the assignee of the present application, is taught and claimed a new method of producing a record of information and especially images by the selective application of energy above a certain threshold to a layer of dispersion imaging material. The just mentioned application teaches also new dispersion imaging materials and imaging structures containing them. In addition to inorganic imaging materials the said copending application teaches also the use of organic dispersion imaging materials. The present application concerns new preferred organic dispersion imaging materials and imaging structures containing them, which can be employed with particular benefit for recording information and for imaging by the selective application of energy to these structures, so as to provide in selected areas energy above a certain threshold to bring about dispersion in said selected areas of the structure.

In the following specification the term "dispersion imaging materials" means materials which are capable of changing their physical shape upon the application of energy above a certain threshold so as to produce a retrievable characteristic different from that of the original material. The term "imaging structure" is used herein to denote a structure which, as a result of containing a dispersion imaging material, is capable of recording information upon the application of energy above a certain threshold to selected areas thereof. The information may be retrieved by any desired means, such as by the application of energy at moderate levels and below the above said threshold or by the human eye. Generally, the record of retrievable information will be called herein an "image" particularly if the read-out is accomplished by the use of electromagnetic energy, such as light energy.

In brief, the present invention provides new imaging materials, which comprise a layer comprising organic dispersion imaging material. The organic dispersion imaging material may be present in the layer in form of flattened, preferably flake-like particles which may be obtained from, for instance, essentially globular particles of cross-linked organic polymeric particulate materials by compression above a critical temperature followed by freezing in of the flattened shape. When the flattened particles are subjected to imaging energy above a certain threshold, they shrink back to their original shape, thus providing an image.

Preferably, the flattened or flake-like particles are oriented in the imaging material in such manner, that their major planes (largest dimension) are essentially or at least as much as is possible parallel to the major plane or surface of the layer of imaging material wherein they are comprised. In this manner, in the case of the use of electromagnetic radiation for read-out, an "opaque" layer is produced. Upon the selective application of energy above a certain threshold, the flattened, flake-like particles "soften" and resume their original essentially spherical shape. In this manner, an originally more or less continuous layer formed by the flakes is broken up into a multiplicity of individual, essentially spherical particles. In the case that no substrate is used, the spherical particles thus formed fall out, leaving open spaces in an otherwise continuous layer of flakes to form the image. Generally, it is preferred, that the continuous layer is contained on a substrate of a material, which is transmissive or reflective for the energy used for read-out. In this case, the "dispersed", essentially spherical particles may fall off or they may adhere to the substrate. In the latter case, the essentially spherical particles formed by the individual flakes are spaced from each other by a considerable distance, making the areas of the imaging structure containing them essentially transmissive for the read-out energy, thereby forming the desired image.

Since many of the organic polymeric materials useful in the practice of the present invention are transmissive or essentially tranmissive or reflective for electromagnetic radiation of the type commonly used for read-out, it is generally preferred, that the particulate organic polymeric material is provided with a material, which renders it "opaque" or non-reflective for the radiation used for read-out. In the case of the visible electromagnetic radiation, dark dyes, such as nigrosin or fine dark pigments, such as carbon black or finely particulate metal or other pigments may be incorporated into the organic polymeric material. In this manner, the areas subjected to the imaging energy become transmissive to the read-out energy, while those areas of the layer in the imaging structure, which have not been subjected to the imaging energy remain opaque or essentially non-transmissive. In other words, the just described materials produce a positive image from a positive mask, i.e. the materials are positive working. This and their low cost makes them particularly suitable for use in office copiers or the like as will be described hereinafter in detail.

Instead of providing the particulate organic polymeric material with a material which renders it opaque or non-reflective, it may also be provided with a material which renders it reflective. Examples of such materials are finely dispersed pigmentary material of light color such as zinc oxide, titanium dioxide, aluminum flakes etc. In this embodiment of the invention, one uses preferably a dark or non-reflective substrate to achieve the differential in reflectance for trouble-free human read-out.

The just described imaging materials contain the dispersion imaging material in form of flattened or flake-like particles, to produce positive images. The invention comprises also imaging materials, which are by a similar mechanism negative working. In this case, originally flat or flake-like particles of crosslinked polymer are brought into an essentially spherical particulate state by heating above a critical transition temperature and by freezing in the spherical shape. When the imaging material containing these particles is selectively subjected in selected areas to imaging energy which "softens" the material by the absorption of energy above the said threshold, the essentially spherical particles become flat, thus forming opaque areas, where the imaging energy was applied. In the non-image areas, i.e. the areas which have not received imaging energy, the layer remains transmissive for the read-out energy, thereby producing a negative image. Generally, however, it is preferred to employ the material of the invention in such manner, that it is positive working.

In the following, the preferred embodiments of the invention will be described by way of example on the basis of the attached drawings.

Other objects, advantages and features of the invention will become apparent to those skilled in the art from the following description and claims of the invention and from the attached drawings in which:

Figure 1:
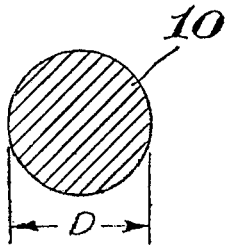
FIG. 1 is a sectional view of an essentially spherical particle of a crosslinked organic polymer as it may be used as the starting material in one embodiment of the invention.

Referring to the drawings, FIG. 1 represents a spherical particle 10 as it may be used as the starting material in one embodiment of the invention. Particle 10 may consist of a crosslinked organic polymer of a composition to be described hereinafter. For the preparation of the imaging structure of the invention, energy is applied to particle 10 in an amount sufficient to bring its temperature to a level above the glass transition temperature tg or the melting temperature tm, respectively, depending on whether the material is amorphous or crystalline. At or above this temperature the polymer softens or melts, while the crosslinks remain intact. In spite of the retention of the crosslinks, the polymer softens and loses at the elevated temperature at or above tg or tm its solid-like qualities, but remains rubbery. The polymer is thereafter compressed, e.g. between heated rollers to form a flat "cake" or flake 12 (see FIG. 2) of an approximately circular configuration. The cake or flake is flash cooled to freeze in its flattened form. As a result of the crosslinks the flake has a memory for the original spherical shape.

Figure 2:
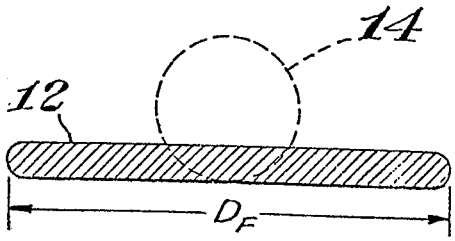
FIG. 2 shows a section of the particle of FIG. 1, after it has been flattened at an elevated temperature and frozen in the flattened state.

If the diameter D of the spherical particle in FIG. 1 is 1, the diameter $D_F$ of the flake is greater, preferably a multiple. In the drawing it is shown to be about 5–6 times that of D. Depending on the material it may be anywhere from 2–20 times that of D or more, if desired. If $D_F$ in the example of FIG. 2 is 5 times that of D the area covered by the flake 12 is 25 times that of the area covered by the sphere (1) in FIG. 1. Generally, the area covered by the flat cake or flake is approximately the square of the multiple by which its diameter is increased over that of the original spherical particle 10.

The foregoing considerations have been made on the assumption, that the flake is preferably circular. This may not be the case in practice and the invention covers any desired irregular form of the flakes or cake. Since the flake or cake has retained, due to the crosslink bonding in the original polymer, a memory for its original shape, it will assume approximately this original shape, as soon as the polymer is heated above the said transition temperature tg or melting temperature tm, respectively to assume the spherical shape as indicated by the broken line 14 in FIG. 2.

For practical purposes one will select a temperature which is essentially above the tg or tm, respectively of the polymer to permit ready deformation of the polymer without essentially breaking the crosslink bonds or chains. Similar considerations apply to the temperature and/or threshold of the imaging energy applied in imaging, as will be set out below.

The particle 10 has been shown as a perfect sphere. It is, for operativeness, not necessary that the original particles are spheres. They may have any regular or irregular form derived therefrom. They may be flattened spheres, irregular ragged particles, cubes or pyramids and any form derived therefrom. Important is only, that their dimensions in the direction of all three axes are of the same general order, for instance, in a ratio varying no more than about 2 or 3 from the mean value. For the purposes of the invention, these particles of all these various forms will be called "spherical particles" even though they may in fact not be spherical.

The original spherical or otherwise shaped particle may be made in any desired manner. They may be made by emulsion polymerization in the presence or absence of a crosslinking agent. For instance, in the case of polystyrene or the like they are preferably produced by emulsion or perl polymerization in the presence of sufficient crosslinking agent to produce the desired degree of crosslinking. In these cases, the spherical starting particles may be simply recovered by filtration of the polymerization mixture. Preferably, the filtered off particles are washed and dried before they are converted into the flattened cakes by the procedure to be described hereinafter.

If it is not possible to produce the polymer by emulsion or perl polymerization, the polymer may be produced by any other desired method, for instance, by bulk polymerization with or without a crosslinking agent. The bulk polymer may be broken up to the essentially spherical particles, for instance, by grinding at low temperature, rubbing, milling, shaving, cutting, etc. If desired, the polymer can be crosslinked in a separate step, before or after breaking it up to the essentially spherical particles, for instance, by subjecting it to irradiation from a radiation source such as cobalt 60 or the like. This latter method is generally preferred in the case of polyethylene and similar polymers, whereby the radiation induced crosslinking is preferably effected while the polymer is in the molten state. Upon cooling the crosslinked polymer crystallizes. Radiation from cobalt 60 or similar radiation sources is known to cause crosslinking of polymeric materials of various kinds without otherwise affecting the polymer. As stated, the radiation induced crosslinking may be applied before or after breaking the polymer up to the desired essentially spherical particles of the desired size. For best operation, however, it is preferred, that in the case of polyethylene or similar material the polymer particles are prepared by suitable polymerization method to form the particle of linear polymer, which thereafter may be crosslinked in form of a slurry or latex or the like or in dry form by the above mentioned radiation source or by any other radio active source. If the polymer is to be made from ethylenically unsaturated monomers such as polystyrene and the like, it is generally more desirable to add a crosslinking agent to the polymerization mixture, as is well known in the art, to directly produce the particles having the desired degree of crosslinking. In the case of condensation polymers, crosslinking may be achieved by the addition of crosslinkers, such as trifunctional reactants, or by subsequent irradiation as described above.

The spherical particles may be composed of any desired polymeric material which, in crosslinked form has or can develop a plastic memory. Preferred are the polymers, which are derived from an ethylenically unsaturated monomer, such as ethylene, styrene, butadiene, acrylic acid and its derivatives and so forth. By suitable choice of mixtures of the monomers and if applicable of the crosslinking agent as the starting material for the polymer, any desired property may be given to the crosslinked polymeric material to suit the requirements of any particular imaging material and imaging task. By suitable choice of the monomers or monomer mixture a polymer can be produced which has a low tg or tm and which therefore requires little imaging energy for the reconversion of the flake-like flat particles into the dispersed, spherical particles. If, for any reason a higher tg or tm is desired, the requirements of imaging energy may be kept low by the expedient to be described later herein in connection with the operation of the new imaging method. Preferred are fine particles, which comprise polyethylene subsequently crosslinked by high energy radiation. Thereby, it is preferred to use a polyethylene, which has a very broad molecular weight distribution.

Other suitable polymeric materials include the various polyamids, polyesters, and other condensation polymers having a memory in their crosslinked state and being deformable at an elevated temperature. Any other polymer, which fulfills these requirements may also be used including some organic materials which normally are not considered to be polymeric materials.

Generally, the spherical particles of the polymeric material may have any desired size, provided they can conveniently be brought into the flattened flake-like state. For the sake of convenience and for the production of optimum results, the individual spherical particles have preferably an intermediary size, such that the film of flattened flakes in the imaging material is preferably formed by a single layer or by a small number of layers of the flake-like particles. As will be appreciated, if the flake-like particles are present in the film in too many layers the efficiency of the imaging material will drop. Most preferred is a single or double layer of the flat flakes in the imaging film. To achieve sufficient opacity the flattened particles should not be too thin and too small. Particles of the proper size provide, with suitable ratios of flattening film layers of from 1/100 microns to about 5 microns which provide good opacity, if sufficient organic dye such as nigrosin or pigment such as carbon black is added to the polymer. In the dispersed state, the spherical particles of the preferred size range provide nearly perfect transparency in the case of a transparent substrate or nearly perfect reflection, if a reflective substrate is used due to their relatively small size in relation to the area available. In this manner, sharp contrasting images may be readily produced from the imaging materials of the invention comprising such substrates as glass, transparent or translucent plastic such as cellulose acetate, Mylar, polyester and the like or on reflective substrates such as paper, cardboard and the like. The low cost of the polymeric materials and the low cost of producing the imaging structures of the invention make the material of the invention especially useful for use in copying machines of various kinds. If such materials as polyethylene on paper are used, a sheet of the copying material of the invention costs barely more than a sheet of good bond paper normally used for typing. This makes the materials of the invention highly desirable as an all around copying material for office and home use. Since generally only radiant heat is needed as the imaging energy, copying machines handling this material may be built very inexpensively.

If the tg or tm, respectively, of the polymeric material is selected to be close to room temperature the differential of heat transmission by the original in the transmissive areas as against the areas of lesser transmissiveness may be sufficient to bring about in the copying material of the invention the selective dispersion. If a higher tg or tm is desired for greater stability of the copy document, the copying material of the invention may be simply preheated to a temperature close to but below the temperature, at which dispersion takes place. The differential in heat provided by the transmissive areas of the original is thereby sufficient to bring about selective dispersion in the copying material. In this manner, the levels of the applied imaging energy may be kept low enough to avoid damage to the original.

The method of the invention may be operated as stated, with radiant heat being the imaging energy. If desired, other energy forms may be used which, by impinging on the layer of imaging energy generate heat. It is also possible to use heat by convection or contact as the imaging energy.

The film or layer comprising the flattened spherical polymeric particles may be readily produced from the above described spherical particles by heat compression at a suitably selected temperature (e.g. about 140° C. in the case of crosslinked polyethylene) followed by quick chilling below tg or tm, respectively. In practice, the layers may be formed by feeding the dry powder of the spherical polymeric particles into the nip of a pair of heated rollers, where they are uniaxially compressed to form a film containing a single layer or a layer of a small number of flakes one above the other. Thereafter the film may be extruded into a bath of cold liquid, such as water to achieve instant cooling or chilling below tg while the material is still in the flattened state. In another embodiment of the invention, the powder is spread onto a cold or water cooled plate and a heated roller is run over it to achieve instantaneous deformation of the spherical particles to form a film of the flat flakes as described above. Thereafter a substrate such as paper may be adhered to the film of flattened polymeric particles. After removal of the sheet, new powder of spherical polymeric material may be applied and the operation is repeated to form any number of sheets of copying material. Care must be taken in the selection of the temperature in the various steps, that the flakes do not adhere too tightly to each other. This can be avoided by selection of the proper temperature (e.g. about 140° C. in the case of crosslinked polyethylene) in each step such that the flattened crosslinked polymer particles adhere to each other to form a coherent film without losing their integrity. Because of the crosslinked nature of the polymer this condition can usually be achieved very readily. If the deformation of the spherical particles is effected on and in the presence of a substrate, the individual flattened particles need not necessarily adhere to each other as long as they adhere to the substrate.

Figure 3:
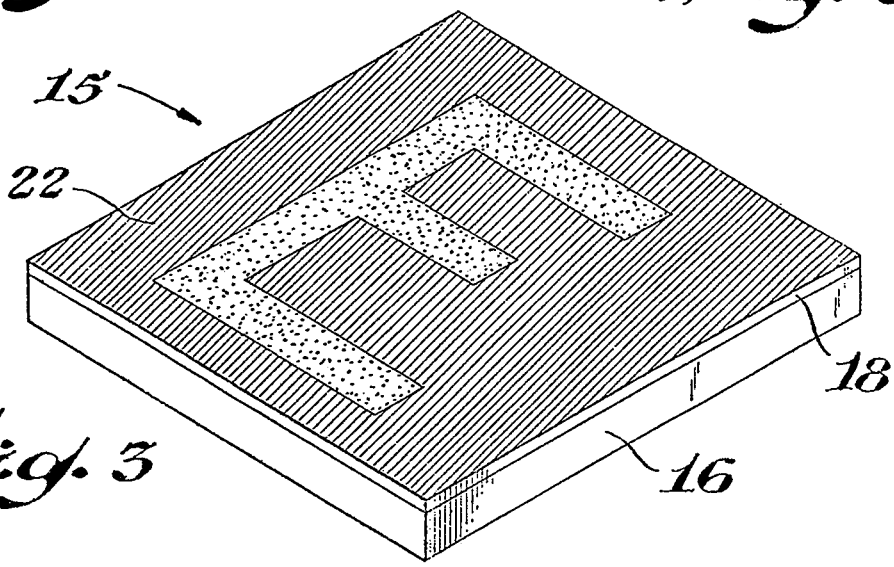
FIG. 3 is a perspective view of an imaging structure of the invention, comprising a layer of the organic dispersion imaging material on a substrate and an image produced thereon.
Figure 4:
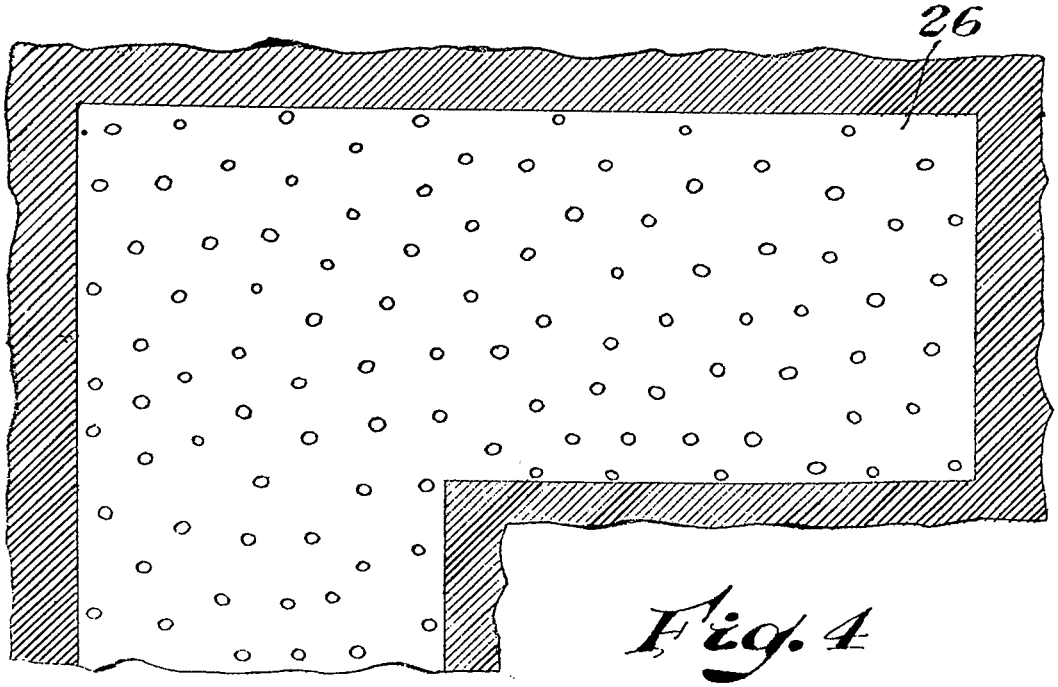
FIG. 4 is an enlarged fragment in top elevation of the structure of FIG. 3 showing the "dispersed" spherical particles in the image areas and an opaque continuous surface in the non-image areas.

FIG. 3 shows an imaging structure 15 of the invention. Substrate 16 may be white paper, such as a medium grade of filled paper. To the top thereof is adhered a thin layer 18 of a film of the flattened polymeric material as described above, such as lightly crosslinked polyethylene. For the production of a copy, the imaging structure may be placed face down onto and in contact with an original comprising the white letter E on a black background. Radiant heat is thereafter applied onto sheet 15, for instance, in a conventional device as it is used for thermographic printing. The white letter E reflects the heat, back into the sheet 15 of copying material, which thereby is heated to a temperature above tg or tm and high enough to cause dispersion of the dispersion imaging material in the area of the letter E to produce a dispersed image 20 of the letter E. The flattened opaque particles in the non-image area 22 form a continuous opaque or black background such that an exact positive copy of the original is formed. As is readily apparent from FIG. 4, the flattened particles recover their original spherical shape in the image areas, i.e. in the areas which are heated in the imaging process above tg or tm to form the "dispersed" spherical particles 24. Between particles 24 is no polymeric opaque material, i.e. areas 26 between the particles are transparent or reflective, if the substrate, comprised in the imaging structure is reflective.

Imagewise dispersion of the flattened particles may likewise be achieved by exposing the copying material of the invention through a mask or other imaging structure to radiant heat energy. In this case, the material is likewise positive working, as it is if the image is projected onto the copying material in conventional manner, for instance, in an enlarger or similar device.

The "dispersion" of the flattened particles can be greatly facilitated in another embodiment of the imaging material and method of the invention. In this embodiment, a material is added to polymer which upon subjection to imaging energy is transformed from a polymeric state into a monomeric state. A typical material of this type is poly-α-methyl-styrene, which upon subjection to electromagnetic energy depolymerises to form monomeric α-methyl styrene. When this material is admixed to the polymer, such as crosslinked polystyrene, in the flattened particles, the poly-α-methyl styrene depolymerises in the areas, where it is subjected to imaging energy containing electromagnetic radiation. The monomeric α-methyl styrene, where it is formed in the image areas has a plasticizing effect, lowering the transition temperature of the polymer making up the flattened particles. In this manner, less heat energy is needed to soften the flattened particles and to "disperse" them to reform the essentially spherical particles in the image areas.

If desired, this embodiment may be operated in such manner, that the whole structure is heated to a temperature close to the transition temperature of the base polymer but not sufficient to bring about dispersion. Imaging is effected thereby by imagewise application of electromagnetic energy only, which depolymerises the poly-α-methyl styrene and causes plasticization and dispersion in the image areas, while no dispersion takes place under the effect of the overall heating of the structure in all those areas, where no electromagnetic energy has been applied and thus no monomeric α-methyl styrene has been formed. The application of the imaging electromagnetic energy and of the overall heat energy may be achieved simultaneously or in two separate steps. For instance, the structure may be subjected to sufficient electromagnetic energy for sufficiently long time to cause depolymerization of essentially all the poly-α-methyl styrene to form a plasticized mixture having a transition temperature $tg_2$, which is appreciably lower than the transition temperature tg of the mixture of polymer and poly-α-methyl styrene. Thereafter, the structure is briefly placed on a hot plate or subjected to IR radiation to hot air at a temperature between tg and $tg_2$ to cause dispersion and reformation of the essentially spherical particles in all those areas, which have been subjected to the electromagnetic imaging energy and no dispersion takes place in all those areas which have not been subjected to the electromagnetic imaging energy. This embodiment of the method of the invention is especially suitable with particles, which are formed of glass-like polymers.

If sufficient poly-α-methyl styrene is added, the tg may be depressed by the monomer sufficiently to cause dispersion in the imaging areas at room temperature so that the extra heating of the structure may be dispensed with.

The same or similar effects may also be achieved with polymers which are crystalline in the flat, compressed state and which by the admixture of poly-α-methyl styrene and its depolymerization can be processed in the manner as described before due to the lowering of the crystalline melting point of the polymer by the monomer formed in this manner.

EXAMPLE 1

Polyethylene particles in form of small spheres having a diameter of from 10 to 100 microns colored black by a content of carbon black are crosslinked by radiation above the crystalline melting point of the polymer.

The particles are thereafter compressed and flash cooled to a temperature below about 100° C. and preferably to room temperature while still under pressure, to produce a layer of flattened polyethylene particles adhered to a substrate.

When selected areas of the layer are heated to a temperature above the crystalline melting point, the polyethylene in these selected areas reverts to the approximate spherical shape in which it was crosslinked, making these areas essentially transparent to produce an image consisting of areas in which the polyethylene is present in the flattened form (black areas) and areas in which the polyethylene was present in essentially spherical form (transparent areas or white areas, if a reflective substrate like paper is used).

The flattened particles are in the crystalline state and melt upon exposure to the imaging energy into the rubbery state or molten state.

EXAMPLE 2

A copolymer of styrene and a small amount of divinyl benzene or tetraethylene glycol dimethyl-acrylate as a crosslinking agent is prepared in particulate form by conventional emulsion polymerization techniques. The small spheres of crosslinked styrene polymer produced in this manner are isolated, washed and dried.

The powder thus obtained, dyed black by a content of nigrosin, is heated to a temperature about 40° C. above the glass transition temperature tg of the polymer (e.g. to about 140° C.) and compressed while at this temperature and cooled while under pressure to a temperature below about 100° C.

The coherent black structure obtained in this manner is subjected to imaging energy in selected areas to produce an image similar to that described in Example 1.

The polymer, when in the flat shape is a glass and converts into a rubbery material upon heating by the imaging energy to reform the spherical particles, which upon cooling become glassy again.

Numerous other modifications may be made to various forms of the invention described herein without departing from the spirit and scope of the invention.

We claim:

1. A method of storing and retrieving information comprising the steps of (1) providing an imaging structure consisting essentially of an electromagnetic energy transmissive or reflective substrate having adhered on a surface thereof a continuous, opaque layer of mechanically flattened small, individual particles formed of a cross-linked organic polymeric material having a memory for a physical shape which normally is different from the mechanically flattened condition of said particles on the surface of the substrate, said particles being present on said surface of the substrate in a quantity to provide at least a single, continuous, opaque layer of said particles in their mechanically flattened condition on said surface and being characterized in that they are capable upon being subjected to imaging energy above a certain threshold of changing their physical shape from a flattened condition to a shape which will provide in the imaging structure an information retrievable characteristic determined at least in part by particles of cross-linked organic polymeric material in said layer which have undergone a change in physical shape due to exposure to imaging energy above a certain threshold and particles in said layer of the material which have not been exposed to imaging energy above said certain threshold and which have not as a result thereof undergone a change in physical shape from their original mechanically flattened condition, (2) applying imaging energy above said certain threshold in a preselected pattern to the layer of flattened particles of cross-linked organic polymeric material to effect a change in physical shape in the particles comprising said layer in the areas thereof corresponding to said pattern of image energy and (3) detecting the change in condition of the layer of particles of cross-linked organic polymeric material due to the change in physical shape of the imaging energy exposed particles in the layer by directing electromagnetic energy upon the imaging structure to determine visually or otherwise the change in said layer.

2. The method of claim 1 wherein the cross-linked organic polymeric material comprises a mixture of polystyrene and poly-α-methyl styrene, and the imaging energy is electromagnetic radiation whereby depolymerization of the poly-α-methyl styrene in the mixture occurs to provide a polymer mixture having a lowered glass transition temperature.

3. The method of claim 2, comprising the step of heating said structure to a temperature above the lowered glass transition temperature of the polymer mixture but below the glass transition temperature of the polystyrene.

4. A method according to claim 1 wherein the mechanically flattened particles have their major surface essentially in a plane parallel to the horizontal plane of the substrate surface to which the particles are adhered.

* * * * *